US011834210B2

(12) United States Patent
Kato

(10) Patent No.: US 11,834,210 B2
(45) Date of Patent: Dec. 5, 2023

(54) BINDING MACHINE

(71) Applicant: KYOWA LIMITED, Osaka (JP)

(72) Inventor: Kazuharu Kato, Gifu (JP)

(73) Assignee: KYOWA LIMITED, Osaka (JP)

( * ) Notice: Subject to any disclaimer, the term of this patent is extended or adjusted under 35 U.S.C. 154(b) by 518 days.

(21) Appl. No.: 17/136,082

(22) Filed: Dec. 29, 2020

(65) Prior Publication Data

US 2021/0114754 A1 Apr. 22, 2021

Related U.S. Application Data

(63) Continuation of application No. PCT/JP2018/033115, filed on Sep. 6, 2018.

(30) Foreign Application Priority Data

Jul. 6, 2018 (JP) ..... 2018-129160

(51) Int. Cl.
*B65B 13/28* (2006.01)
*B65B 13/06* (2006.01)

(52) U.S. Cl.
CPC ..... *B65B 13/28* (2013.01); *B65B 13/06* (2013.01)

(58) Field of Classification Search
CPC ..... B65B 13/02; B65B 13/04; B65B 13/06; B65B 13/18; B65B 13/24; B65B 13/28; B65B 13/285; E04G 21/122; E04G 21/123; B21F 15/04
See application file for complete search history.

(56) References Cited

U.S. PATENT DOCUMENTS 4,798,231 A * 1/1989 Glaus ..... E04G 21/123 140/57
5,217,049 A * 6/1993 Forsyth ..... E04G 21/122 140/57
5,279,336 A * 1/1994 Kusakari ..... B65B 13/285 140/57
5,657,799 A 8/1997 Kusakari et al.
2016/0108632 A1 4/2016 Lu

FOREIGN PATENT DOCUMENTS

JP H07-069319 A 3/1995
JP H09-013677 A 1/1997
JP 4469458 B2 5/2010

OTHER PUBLICATIONS

International Search Report issued in PCT/JP2018/033115 dated Nov. 13, 2018 with English Translation (4 pages).

* cited by examiner

*Primary Examiner* — Teresa M Ekiert
(74) *Attorney, Agent, or Firm* — Nakanishi IP Associates, LLC

(57) ABSTRACT

A binding machine includes a feeding device configured to feed a binding material, a movement passage through which an object to be bound to be moved to a binding executing position passes, a movable member configured to be moved from a premovement position where at least a part thereof is disposed in the movement passage, by being pushed by the to-be-bound object when the to-be-bound object moves toward the binding executing position, a winding member configured to wind the binding material fed to a given position by the feeding device around the to-be-bound object, by rotating while being transmitted power of the movable member moved from the premovement position, and a twisting device configured to twist the binding material wound around the to-be-bound object by the winding member.

13 Claims, 6 Drawing Sheets

BINDING MACHINE

TECHNICAL FIELD

The present disclosure relates to a binding machine which binds an object to be bound by winding a binding material around the object to be bound and twisting it.

BACKGROUND ART

Conventionally, it is known that one type of binding machines which bind an object to be bound by winding a binding material around the to-be-bound object and twisting it. For example, the binding machine is used for binding a bag opening etc. by a string-shaped binding material.

Patent Document 1 discloses a binding machine which winds a binding material around an article, and twists it tight. The binding machine includes a feeding device which feeds the binding material for article binding, a bending and winding device which winds the fed binding material around the article, a clamping device which further rolls up the bent and wound binding material so as to conform to the article to tighten and fix it, a cutting device which cuts the binding material, a twisting device which twists the bent and wound binding material to tighten it, an insertion slot clamping device which inserts a rear part of the cut binding material to tighten and fix it, and a feeding drum which feeds the binding material to a rear end part of a casing body. This binding machine rotates a feed disk in a given direction to operate the feeding device, the insertion slot clamping device, the cutting device, and the twisting device, couples a linkage to a linkage drive shaft provided to the feed disk so as to be rotatable and transversely movable, and rotates the feed disk in a given direction to operate the bending and winding device and the clamping device.

REFERENCE DOCUMENT OF CONVENTIONAL ART

Patent Document

[Patent Document 1] JP4469458B2

DESCRIPTION OF THE DISCLOSURE

Problem to be Solved by the Disclosure

Meanwhile, in the conventional binding machine, in order to drive various devices by a single motor, a motor is provided to the feed disk, and power of the motor is transmitted through the linkage to other devices which need the power. However, the bending and winding device is away from the motor. Thus, in order to transmit the power of the motor to the bending and winding device, it is necessary to provide the components, such as the linkage comprised of long members, and the linkage drive shaft and a clamp drive shaft coupled to the linkage. Therefore, the machine configuration becomes complicated and it is difficult to reduce the manufacturing cost.

The present disclosure is made in view of such a situation, and one purpose thereof is to provide a binding machine with a simplified machine configuration, which binds an object to be bound by winding a binding material around the to-be-bound object and twisting it.

SUMMARY OF THE DISCLOSURE

In order to solve the above problem, according to the first aspect of the present disclosure, a binding machine configured to bind an object to be bound by winding a binding material around the to-be-bound object and twisting the binding material, is provided. The binding machine includes a feeding device configured to feed the binding material, a movement passage through which the to-be-bound object to be moved to a binding executing position passes, a movable member configured to be moved from a premovement position where at least a part of the movable member is disposed in the movement passage, by being pushed by the to-be-bound object when the to-be-bound object moves toward the binding executing position, a winding member configured to wind the binding material fed to a given position by the feeding device around the to-be-bound object, by rotating while being transmitted power of the movable member moved from the premovement position, and a twisting device configured to twist the binding material wound around the to-be-bound object by the winding member.

According to the second aspect of the present disclosure, in the first aspect, the binding machine may further include an elastic deforming part configured to return the movable member to the premovement position, and return the winding member to a prerotation position before the winding member rotates to wind the binding material, by a restoring force.

According to the third aspect of the present disclosure, in the second aspect, the movable member may have a transversing part crossing the movement passage, a first slide support part connected to one side of the transversing part with respect to the movement passage and slidably supported, and a second slide support part connected to the other side of the transversing part with respect to the movement passage and slidably supported. The elastic deforming part may have a first spring part configured to cause a restoring force for returning the movable member to the premovement position to act on the first slide support part, and a second spring part configured to cause a restoring force for returning the movable member to the premovement position to act on the second slide support part. In the movable member, a power transmission part configured to transmit power to the winding member may be provided to the first slide support part. The first spring part may have a larger restoring force than the second spring part.

According to the fourth aspect of the present disclosure, in any one of the first to third aspects, the movable member may be provided slidably along the movement passage. In a state where the movable member is located at the premovement position, a distance from a rotational center of the winding member to an acting point where a force transmitted from the movable member acts on the winding member may be 0.5 cm or more and 3 cm or less.

According to the fifth aspect of the present disclosure, in any one of the first to fourth aspects, the binding machine may include a switch configured to contact the movable member or the winding member at a timing when the to-be-bound object reaches the binding executing position, to be switched to an ON state, and a motor configured to be supplied with electric power when the switch is switched to the ON state to drive the twisting device.

According to the sixth aspect of the present disclosure, in any one of the first to fourth aspects, the binding machine may include a switch configured to contact the movable member or the winding member at a timing when the movable member returns to the premovement position, to be switched to an ON state, and a motor configured to be supplied with electric power when the switch is switched to the ON state to drive the feeding device.

According to the seventh aspect of the present disclosure, in any one of the first to sixth aspects, the binding machine may further include a binding material passage configured to guide to the given position the binding material inserted from outside. The binding material fed by the feeding device may advance in an area adjacent to the movement passage along the movement passage, to the given position from an exit of the binding material passage.

According to the eighth aspect of the present disclosure, in any one of the first to seventh aspects, the twisting device may have a twist shaft rotatably provided, and a hooking part fixed to the twist shaft and configured to rotate while the binding material wound around the to-be-bound object being hooked thereon when the twist shaft rotates. The binding machine may further be provided with a putting-aside device configured to bring the binding material closer to the twist shaft before the binding material is twisted by the twisting device, the putting-aside device being moved by power of the movable member moved from the premovement position being transmitted.

Effect of the Disclosure

According to the present disclosure, the movable member is moved by being pushed by the to-be-bound object when the to-be-bound object moves toward the binding executing position, and further the winding member winds the binding material around the to-be-bound object, by rotating while being transmitted the power of the movable member. That is, the binding material is wound around the to-be-bound object by using the force for moving the to-be-bound object to the binding executing position. Thus, unlike the conventional binding machine, it is not necessary to transmit the power of the motor to the winding member, and the components which made the machine configuration of the conventional binding machine complicated can be omitted. Therefore, according to the present disclosure, the binding machine which binds an object to be bound by winding a binding material around the to-be-bound object and twisting it, can be provided, which is capable of simplifying the machine configuration.

According to the second aspect of the present disclosure, since the elastic deforming part configured to return the movable member to the premovement position and return the winding member to the prerotation position is provided, the preparation for the next binding after a binding to the to-be-bound object is finished can be automatically performed.

According to the third aspect of the present disclosure, the restoring force caused to act on the first slide support part to which the power transmitting part for the winding member is provided, is larger than the restoring force caused to act on the second slide support part. Therefore, the movable member can be returned stably since the force for returning the movable member to the premovement position is maintained with balance at both sides of the movement passage.

According to the fourth aspect of the present disclosure, the distance from the rotational center of the winding member to the acting point where the force transmitted from the movable member acts on the winding member (hereinafter, referred to as a "center-acting point distance") is 0.5 cm or more and 3 cm or less. Here, in order to wind the binding material, it is necessary to rotate the winding member comparatively largely. For that purpose, it is possible to increase the sliding range of the movable member. However, if the moving range of the movable member is increased, the pushing distance of the movable member becomes longer for a user. Moreover, it is also possible to rotate the winding member largely by shortening the center-acting point distance. However, in this case, the force required for moving the movable member increases. Thus, according to the present disclosure, by setting the center-acting point distance 0.5 cm or more and 3 cm or less, the force required for moving the movable member does not become excessively large, while suppressing the moving range. Therefore, it can be prevented that the burden of the user pushing the movable member increases.

According to the fifth aspect of the present disclosure, the motor which drives the twisting device is automatically driven by using the motion of the movable member or the winding member when moving the to-be-bound object to the binding executing position. Therefore, the binding machine can be automated with the simple configuration.

According to the sixth aspect of the present disclosure, the motor which drives the feeding device is automatically driven by using the motion of returning the movable member or the winding member. Therefore, the binding machine can be automated with the simple configuration.

According to the seventh aspect of the present disclosure, the binding material fed by the feeding device advances in an area adjacent to the movement passage along the movement passage, from the exit of the binding material passage to the given position at which the winding to the to-be-bound object by the winding member is possible. Therefore, it is securely prevented that the binding material enters into the movement passage and hinders the movement of the to-be-bound object.

According to the eighth aspect of the present disclosure, by using the force for moving the to-be-bound object to the binding executing position, the binding material is brought closer to the twist shaft before the binding material is twisted. The position of the binding material becomes closer to the rotational center of the hooking part. Therefore, the binding material can securely be twisted by the hooking part.

MODE FOR CARRYING OUT THE DISCLOSURE

Figure 1:
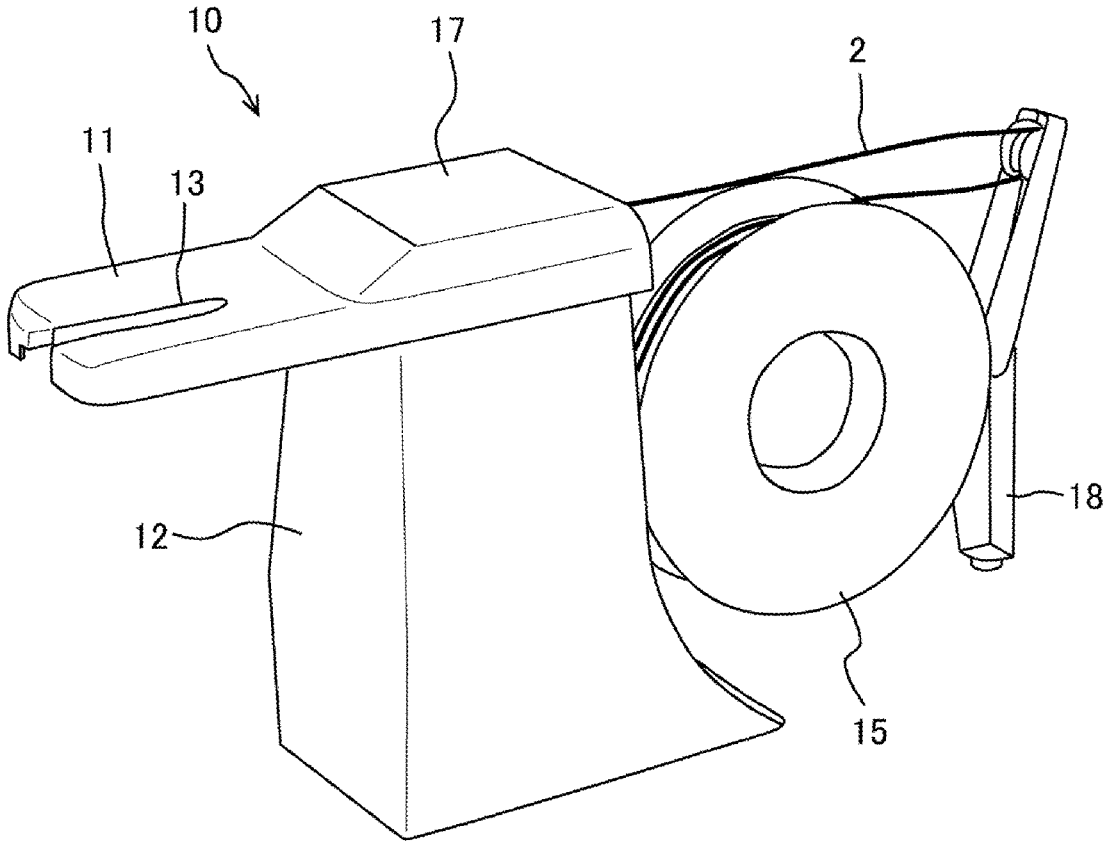
FIG. 1 is a perspective view of a binding machine according to one embodiment.

Hereinafter, one embodiment of the present disclosure is described in detail with reference to FIGS. 1 to 6. Note that the following embodiment is one example of the present disclosure, and therefore, it is not intended to limit the scopes of the present disclosure, applications, and usage.

[Outline Configuration of Binding Machine]

A binding machine 10 is a machine which winds a string-shaped binding material 2 around an object 1 to be bound, and then twists and binds it. The binding machine 10 illustrated in FIG. 1 includes a body part 11 which binds the to-be-bound object 1, a body supporting part 12 which is integrally formed underneath the body part 11 and supports the body part 11, and a reel stand 18 attached behind the body supporting part 12. A movement passage (slot) 13, through which the to-be-bound object 1 is moved to a binding executing position 13*a* where binding is performed, is formed by notching the body part 11. The details of the body part 11 will be described later.

Below, the entrance side of the movement passage 13 is referred to as a "front side," and the opposite side is referred to as a "rear side." The movement passage 13 extends straightly in a front-and-rear direction. Moreover, a direction perpendicular to the front-and-rear direction is referred to as a "width direction." Moreover, the terms "right (side)" or "left (side)" are used as directions when the binding machine 10 is seen from the front side.

The body supporting part 12 is covered with an exterior case 17 together with the body part 11. The external surface of the body supporting part 12 is provided with a power switch and is connected to a power cord.

Electric components (not illustrated) are accommodated in the body supporting part 12. Legs are provided underneath the body supporting part 12. Moreover, a reel 15 is attached to the reel stand 18. The binding material 2 is wound around the reel 15. As the binding material 2, a string-shaped binding material in which a core made of metal or resin is built in a resin string (vinyl string etc.) or paper string may be used.

[Outline Configuration of Body Part]

Figure 2:
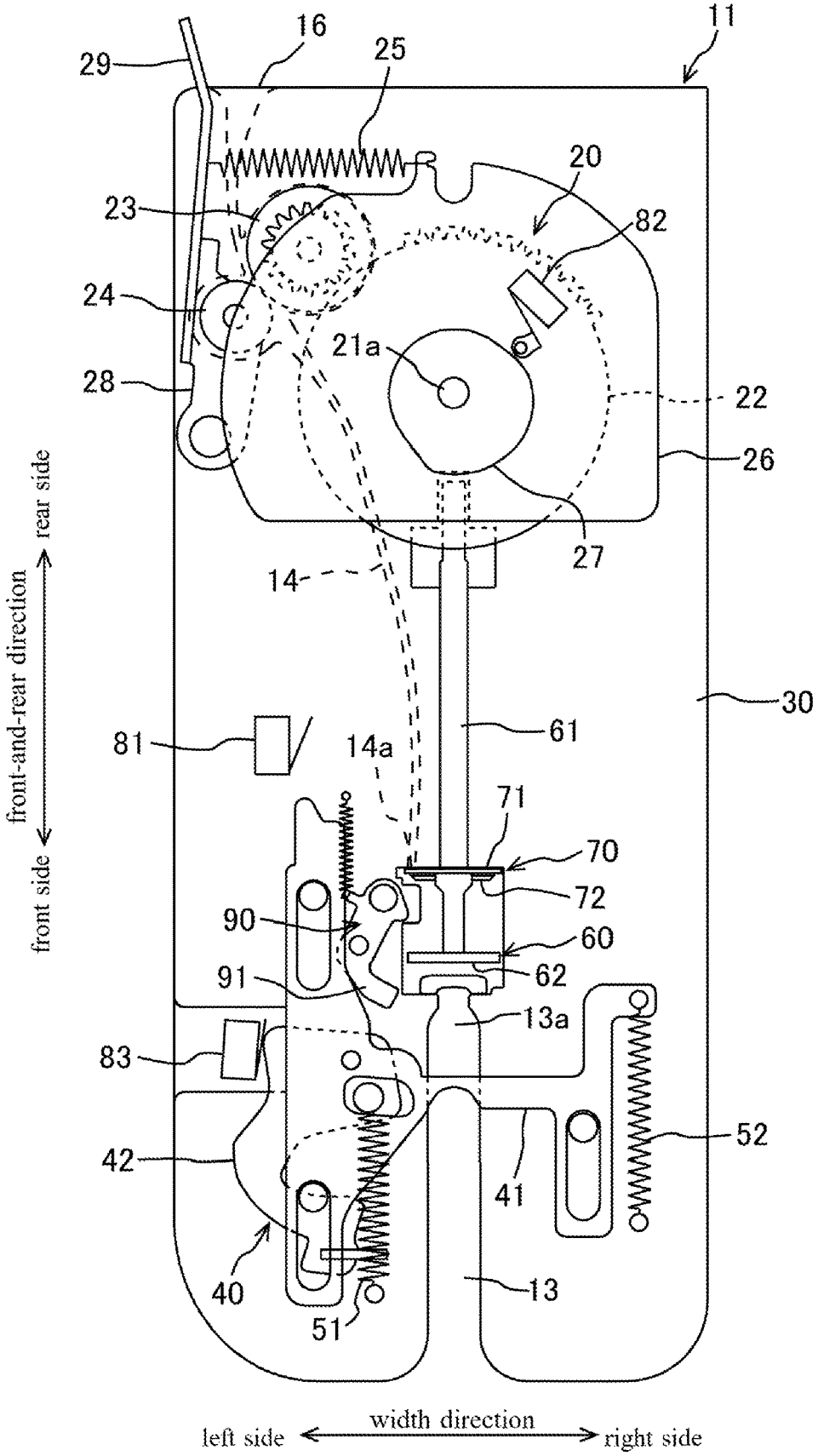
FIG. 2 is a top view of the inside of a body part seen from above.

As illustrated in FIG. 2, the body part 11 includes a feeding device 20, a winding device 40, a twisting device 60, and a cutting device 70. An insertion slot 16 into which the binding material 2 which is unwound from the reel 15 is inserted is formed in a rear surface of the body part 11. Moreover, inside the body part 11, a binding material passage 14 for guiding an end part of the binding material 2 inserted from the insertion slot 16 to a given windable position (given position) is formed. The windable position is a position at which the binding material 2 can be wound around the to-be-bound object 1 by a winding arm 42 (described later).

The binding material passage 14 extends inside the body part 11, horizontally forward from the insertion slot 16, and a hole of a stationary blade 71 (described later) serves as an exit 14*a* of the binding material passage 14. The insertion slot 16 is formed at an outward leftward position side in the width direction. The exit 14*a* of the binding material passage 14 opens at a position leftward from the movement passage 13, near the center in the width direction.

In this embodiment, the binding material passage 14 etc. is configured so that the binding material 2 fed by the feeding device 20 (described later) advances an area adjacent to the movement passage 13 along the movement passage 13, from the exit 14*a* of the binding material passage 14 to the windable position. In detail, in the top view, the binding material passage 14 is bent inward at a location rearward of a part being pinched between a driving roller 23 and a follower roller 24 (described later), and it extends obliquely as it is up to a location slightly rearward of the exit 14*a*. Then, it extends substantially forward from the location slightly rearward of the exit 14*a* up to the exit 14*a*. In more detail, the exit 14*a* of the binding material passage 14 is slightly turned to outward (left side). Moreover, a rotary arm 91 (described later) is disposed forward and leftward of the exit 14*a*. Therefore, the binding material 2 fed forward from the exit 14*a* of the binding material passage 14 advances obliquely after it is turned slightly outward, and then hits the rotary arm 91 so that the advancing direction is corrected to forward. Thus, it is prevented that the binding material 2 fed forward from the exit 14*a* enters into the movement passage 13.

Here, inside the exterior case 17 of the body part 11, a plurality of support plates to which various components (described later) are attached are laminated and fixed (see FIG. 3(*b*)). A support plate part 30 comprised of the plurality of support plates is fixed to the exterior case 17.

[Configuration of Feeding Device]

The feeding device 20 is a device which feeds the binding material 2 forward after binding of the to-be-bound object 1 is finished. As illustrated in FIGS. 2, 3(*a*) and 3(*b*), the feeding device 20 includes a motor 21, a rotary disk 22 coupled to a rotation shaft 21*a* of the motor 21, the driving roller 23 to which a rotational force is transmitted from the rotary disk 22, the follower roller 24 which pinches the binding material 2 with the driving roller 23, an elastic member 25 for rollers which pushes the follower roller 24 against the driving roller 23, a switch mounting plate 26 which covers the rotary disk 22 etc. and is provided with a second switch 82 (described later) at an upper surface thereof, and a switch operating plate 27 attached to the rotation shaft 21*a* on the switch mounting plate 26. The motor 21 is disposed inside the body supporting part 12. Note that FIG. 3(*a*) illustrates a state where the switch mounting plate 26 and the switch operating plate 27 are removed, and formation areas of a backside gear 22*c* and a twist-side gear 63 are hatched. Moreover, in FIG. 3(*b*), illustration of the elastic member 25 for rollers etc. is omitted. Moreover, the axis of the rotation shaft 21*a* extends in the up-and-down direction. This is same for other rotation shafts 23*a*, 24*a*, 28*a*, 42*a*, and 91*a*.

The rotary disk 22 is a plate member of a substantially circular shape in the plan view. As illustrated in FIG. 3(*b*), the rotary disk 22 is provided with a frontside gear 22*b* and the backside gear 22*c*. The frontside gear 22*b* is a gear for rotating the driving roller 23. The frontside gear 22*b* is, for example, a spur gear, and is formed only in a partial angle range of the rotary disk 22. The backside gear 22*c* is a gear for rotating a twist shaft 61 (described later). The backside gear 22*c* is, for example, a contrate gear, and is formed only in a partial angle range of the rotary disk 22.

The driving roller 23 is disposed slightly forward of the insertion slot 16. The driving roller 23 is rotatably attached to the rotation shaft 23*a* fixed to the support plate part 30. The driving roller 23 is integrally formed with a roller-side gear 23*b* which meshes with the frontside gear 22*b*. The roller-side gear 23*b* is, for example, a spur gear and is formed in the entire circumference of the driving roller 23.

The follower roller 24 is disposed at a position which opposes to the driving roller 23. Moreover, the follower roller 24 is rotatably attached to the rotation shaft 24*a* fixed to a support member 28. The support member 28 is rotatably supported by the rotation shaft 28*a* fixed to the support plate part 30. The position of the follower roller 24 changes, according rotation of the support member 28, between a pushing position (a position in FIG. 3(*a*)) where it pushes the driving roller 23, and a separated position (a position leftward of the position in FIG. 3(*a*)) where it is separated from the driving roller 23. The follower roller 24 at the pushing position contacts the driving roller 23 on the binding material passage 14.

A lever 29 which extends rearward from the exterior case 17 is fixed to the support member 28. Moreover, one end part of the elastic member 25 for rollers is attached to the lever 29. The other end part of the elastic member 25 for rollers is attached to a hook of the switch mounting plate 26 in a state where it is elongated from the natural length. Thus, in a state where a user does not apply a force to the lever 29, a pulling force of the elastic member 25 for rollers is transmitted to the support member 28 through the lever 29. Therefore, the support member 28 rotates clockwise in FIG. 3(*a*) so that the follower roller 24 integrally formed with the support member 28 is pushed against the driving roller 23 at the pushing position. Moreover, when the user moves the lever 29 outwardly against the pulling force of the elastic member 25 for rollers, the support member 28 rotates counterclockwise so that the follower roller 24 moves to the separated position. Thus, the binding material 2 which is unwound from the reel 15 and is inserted into the insertion slot 16 can be pinched between the driving roller 23 and the follower roller 24. Note that a coil spring can be used for the elastic member 25 for rollers, for example.

By the above configuration, when the motor 21 rotates, the rotary disk 22 rotates. Then, in the partial rotation angle range of one revolution of the rotary disk 22, the frontside gear 22*b* meshes with the roller-side gear 23*b*, and the rotational force of the motor 21 is transmitted to the driving roller 23. When the driving roller 23 rotates while the binding material 2 is pinched between the driving roller 23 and the follower roller 24, the follower roller 24 also rotates accordingly, and the binding material 2 is fed forward.

Moreover, when the motor 21 rotates, the switch operating plate 27 also rotates above the switch mounting plate 26 where the second switch 82 is attached to the upper surface thereof. The switch operating plate 27 is a cam in which a distance from the center of the rotation shaft 21*a* to the outer circumference changes in the circumferential direction. In the switch operating plate 27, a bulged part 27*a* which bulges outward in a partial angle range in the circumferential direction is formed. While the switch operating plate 27 is rotated, the second switch 82 is switched by the bulged part 27*a* during a period where the bulged part 27*a* opposes to the second switch 82.

[Configuration of Winding Device]

The winding device 40 is a device which automatically winds the binding material 2 around the to-be-bound object 1 by using a force for moving the to-be-bound object 1 to the binding executing position 13*a*. The winding device 40 includes a sliding member 41 which is slidably provided, a winding arm 42 which is rotatably provided, a power transmission part 43 which transmits power from the sliding member 41 to the winding arm 42, a sliding direction regulating part 44 which regulates the sliding direction of the sliding member 41, and a slide returning part 45 which biases the sliding member 41 forward by a restoring force.

The sliding member 41 corresponds to a movable member which is moved from a premovement position where at least a part thereof is disposed in the movement passage 13, by being pushed by the to-be-bound object 1 which is moving toward the binding executing position 13*a*. Moreover, the winding arm 42 corresponds to a winding member which winds the binding material 2 fed to a given position by the feeding device 20 around the to-be-bound object 1, by rotating according to the power transmitted from the sliding member 41. The slide returning part 45 corresponds to an elastic deforming part which returns the sliding member 41 to the premovement position, and returns the winding arm 42 to a prerotation position where it is before the winding arm 42 rotates for winding the binding material 2, by the restoring force.

Figure 4A:
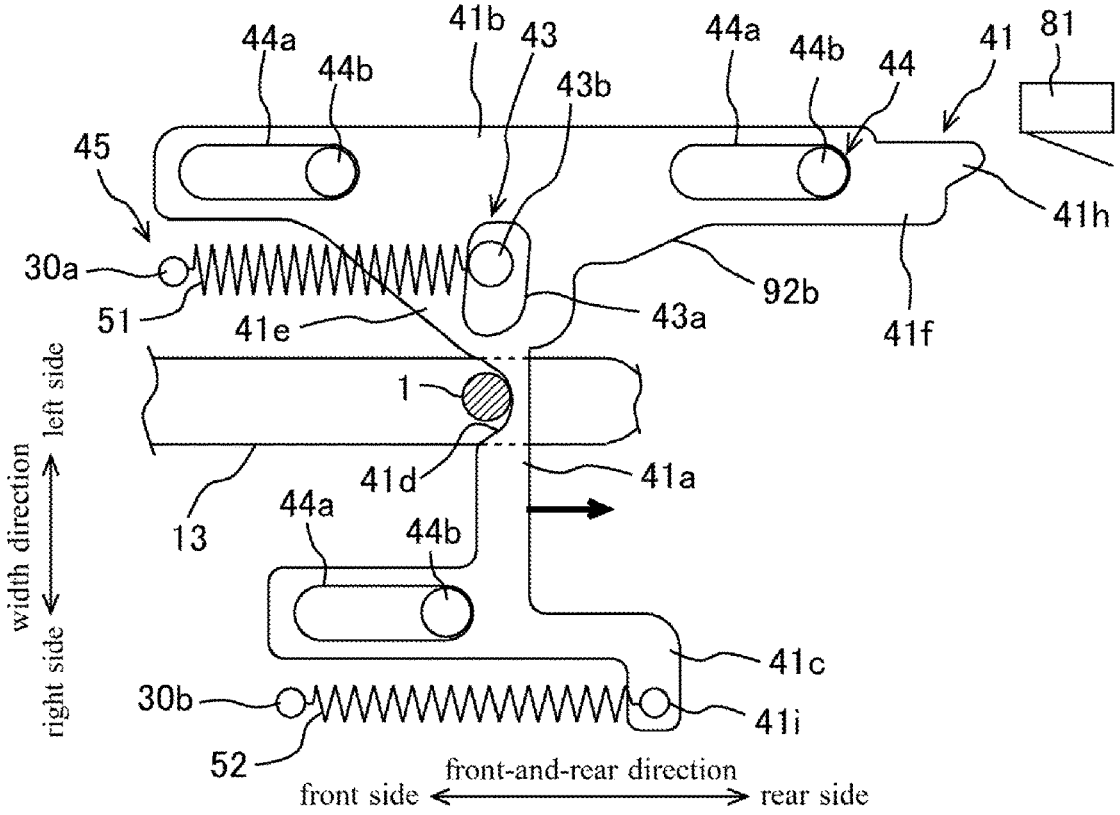
FIGS. 4(*a*) and 4(*b*) are views illustrating a sliding member, where FIG. 4(*a*) is a top view in a state where the sliding member is located at a premovement position, and FIG. 4(*b*) is a top view in a state where the sliding member is located at a movement stopped position.
Figure 4B:
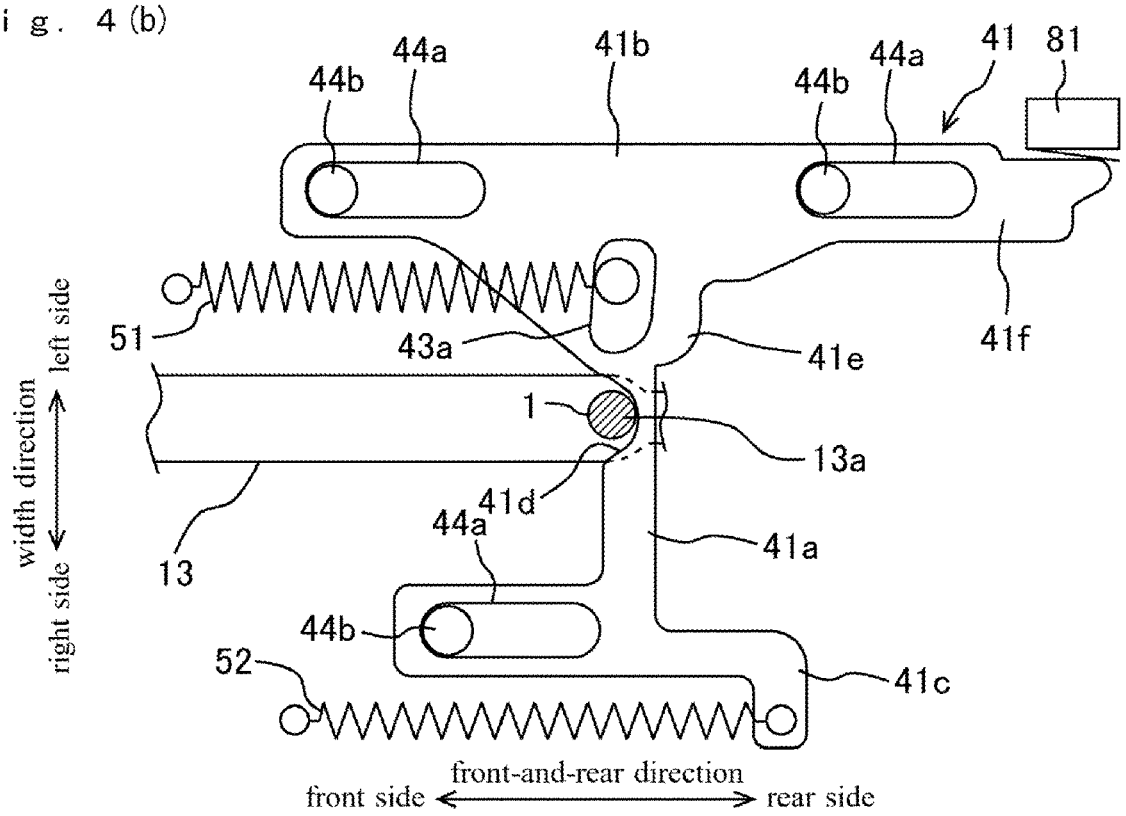

As illustrated in FIG. 4(*a*), the sliding member 41 includes a transversing part 41*a* which crosses the movement passage 13, a first slide support part 41*b* which is connected to one side (left side) of the transversing part 41*a* from the movement passage 13 and is slidably supported, and a second slide support part 41*c* which is connected to the other side (right side) of the transversing part 41*a* from the movement passage 13 and is slidably supported.

The transversing part 41*a* is formed in a straight elongated-plate shape, and extends substantially perpendicular to the extending direction of the movement passage 13. A recess part 41*d* into which the to-be-bound object 1 enters is formed in the transversing part 41*a*, at the front side of the part crossing the movement passage 13. Therefore, the to-be-bound object 1 which pushes the sliding member 41 is difficult to be offset in the width direction of the movement passage 13.

The first slide support part 41*b* includes an inner part 41*e* which spreads toward outside (left side) from the transversing part 41*a*, and an outer part 41*f* of an elongated-plate shape which is formed continuously from the inner part 41*e* and extends in the front-and-rear direction. An elongated hole 43*a* which constitutes the power transmission part 43 is formed in the inner part 41*e*. Moreover, a rearward peripheral part 92*b* which pushes a projection pin 92*a* (described later) is formed in a rear part of the inner part 41*e*. On the other hand, two elongated holes 44*a* which constitute the sliding direction regulating part 44 are formed in the outer part 41*f*. Moreover, a protrusion 41*h* which contacts a first switch 81 (described later) is formed in a rear end part of the outer part 41*f*.

The second slide support part 41*c* is a part of elongated-plate shape which is formed continuously on the outside of the transversing part 41*a* and extends in the front-and-rear direction. An elongated hole 44*a* which constitutes the sliding direction regulating part 44 is formed in the second slide support part 41*c*. Moreover, a second elastic member 52 which constitutes the slide returning part 45 is attached to a pin 41*i* which protrudes from an upper surface of the second slide support part 41*c*.

The sliding direction regulating part 44 includes the three elongated holes 44*a* described above which extend in the front-and-rear direction, and three regulating pins 44*b* inserted in the three elongated holes 44*a*, respectively, to regulate the sliding direction of the sliding member 41 in the front-and-rear direction (the extending direction of the movement passage 13). The three elongated holes 44*a* are equal in the length in the front-and-rear direction. Moreover, the three regulating pins 44*b* are disposed so that their positions in the front-and-rear direction with respect to the elongated holes 44*a* into which the pins are inserted become the same. A sliding range of the sliding member 41 is regulated within a range from the premovement position (a position in FIG. 4(*a*)) which is before the sliding member 41 is pushed by the to-be-bound object 1 to a movement stopped position (a position in FIG. 4(*b*)) rearward of the premovement position. Note that, when the sliding member 41 reaches the movement stopped position, the position of the to-be-bound object 1 inside the recess part 41*d* becomes the binding executing position 13*a*.

The slide returning part 45 includes a first elastic member 51 which pulls the first slide support part 41*b* forward, and the second elastic member 52 which pulls the second slide support part 41*c* forward. The first elastic member 51 corresponds to a first spring part which applies a restoring force for returning the sliding member 41 to the premovement position to the first slide support part 41*b*. The second elastic member 52 corresponds to a second spring part which applies a restoring force for returning the sliding member 41 to the premovement position to the second slide support part 41*c*. For example, coil springs are used for the elastic members 51 and 52. Note that, although in this embodiment the first spring part and the second spring part are comprised of the elastic members 51 and 52, respectively, each spring part may be comprised of a plurality of elastic members.

The first elastic member 51 is attached to a support pin 30*a* fixed to the support plate part 30 at one end part, and is attached to an insertion pin 43*b* which is inserted into the elongated hole 43*a* of the first slide support part 41*b* at the other end part. On the other hand, the second elastic member 52 is attached to a support pin 30*b* fixed to the support plate part 30 at one end part, and is attached to the pin 41*i* of the second slide support part 41*c* at the other end part.

In the slide returning part 45, even when the sliding member 41 is located at the premovement position, the elastic members 51 and 52 are in a state where they are longer than their natural lengths, and therefore, the pulling forces act on the sliding member 41. Then, when the sliding member 41 is moved to the movement stopped position, the elastic members 51 and 52 are extended and the pulling forces increase. In this state, when the to-be-bound object 1 is moved outside the movement passage 13, the force which pushes the sliding member 41 rearward is removed, and the sliding member 41 is returned to the premovement position by the elastic members 51 and 52.

Moreover, the first elastic member 51 is larger in the spring constant than the second elastic member 52. That is, the first spring part has a larger restoring force for retuning the sliding member 41 to the premovement position than the second spring part. In this embodiment, the restoring force which acts on the first slide support part 41*b* provided with the power transmission part 43 to the winding arm 42 is larger than the restoring force which acts on the second slide support part 41*c* not provided with the power transmission part 43. Therefore, the sliding member 41 can be returned with sufficient balance at both sides of the movement passage 13.

The winding arm 42 is rotatably supported by the rotation shaft 42*a* fixed to the support plate part 30. The winding arm 42 is located at the prerotation position (a position in FIG. 5(*a*)), when the sliding member 41 is located at the premovement position. In this state, the entire winding arm 42 is located on the left side of the movement passage 13. Then, interlocking with the sliding member 41 which slides toward the movement stopped position, the winding arm 42 rotates counterclockwise in FIG. 5(*a*), and the winding arm 42 reaches the winding finished position (a position in FIG. 5(*b*)), when the sliding member 41 reaches the movement stopped position. The winding arm 42 includes a plate-shaped arm part 42*b* and a binding material holding part 42*c* attached to a tip-end part of the arm part 42*b*. Note that, in FIG. 5(*b*), the winding arm 42 and a putting-aside device 90 (described later) are indicated by solid lines, and members which overlap therewith and the sliding member 41 are indicated by broken lines.

Figure 5A:
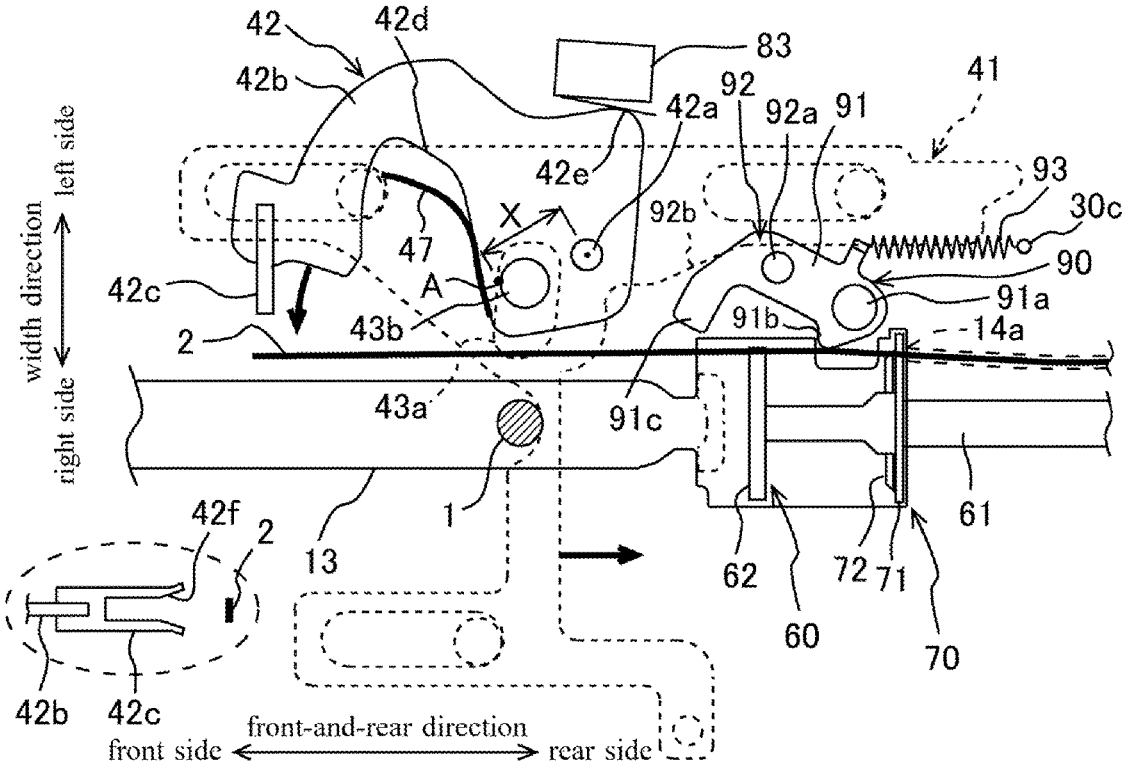
FIGS. 5(*a*) and 5(*b*) are views illustrating a winding arm etc., where FIG. 5(*a*) is a top view in a state where the winding arm is located at a prerotation position, and FIG. 5(*b*) is a top view in a state where the winding arm is located at a winding finished position.
Figure 5B:
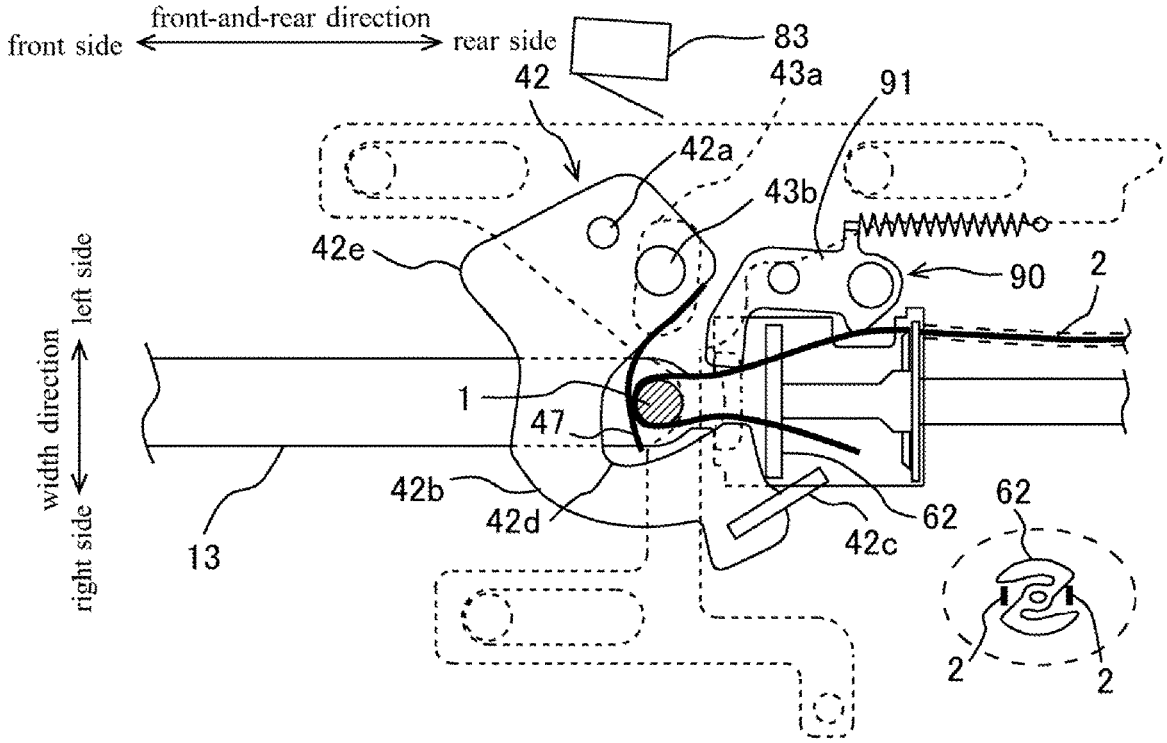

The arm part 42*b* has a shape in planar view in which a belt-shaped part extends from a central part of substantially rectangular shape to which the rotation shaft 42*a* is attached and is bent at an intermediate location. The insertion pin 43*b* which constitutes the power transmission part 43 and is inserted into the elongated hole 43*a* is fixed to the arm part 42*b*, at a location near the rotation shaft 42*a*. Moreover, in the arm part 42*b* located at the prerotation position, the belt-shaped part extends obliquely leftward, and the belt-shaped part extends obliquely rightward from a bent portion. A recess part 42*d* which is dented outwardly is formed inside of the arm part 42*b* (the movement passage 13 side), in order to avoid an interference of the arm part 42*b* with the to-be-bound object 1, when it rotates to the winding finished position. As illustrated in FIG. 5(*b*), the recess part 42*d* located at the winding finished position forms, with the recess part 41*d*, a hole through which the to-be-bound object 1 passes in the up-and-down direction. Moreover, a plate spring member 47 for suppressing that the binding material 2 separates from the to-be-bound object 1 when the binding material 2 is wound around a relatively small to-be-bound object 1, is provided in the recess part 42*d*.

Moreover, a bulged part 42*e* for switching a third switch 83 is formed at an outward position of a rear end part of the arm part 42*b* located at the prerotation position. The bulged part 42*e* contacts the third switch 83 at the prerotation position, and it separates from the third switch 83 when the winding arm 42 rotates counterclockwise from the prerotation position.

The binding material holding part 42*c* is a small piece of substantially rectangular plate shape. Inside a broken line at the lower left of FIG. 5(*a*), a view of the binding material holding part 42*c* seen from the front is illustrated. In the winding arm 42 located at the prerotation position, the binding material holding part 42*c* is fixed to the tip-end part of the arm part 42*b* so that it protrudes to the movement passage 13 side. The binding material holding part 42*c* is perpendicular to the arm part 42*b* so that its short sides extend in the up-and-down direction. A recess part 42*f* into which the binding material 2 fits is formed in a tip-end part of the binding material holding part 42*c*.

When the winding arm 42 rotates slightly counterclockwise from the prerotation position, the binding material 2 fed so that an end part thereof reaches a given windable position is caught by the recess part 42*f* of the binding material holding part 42*c*. Then, when the winding arm 42 is further rotated counterclockwise, the binding material 2 held by the recess part 42*f* is bent so that it is folded back to the feeding side of the feeding device 20, in the plan view. When the winding arm 42 is rotated to the winding finished position, the binding material 2 becomes in a state where it is wound around the to-be-bound object 1.

The power transmission part 43 includes the elongated hole 43*a* which is formed in one of the sliding member 41 and the winding arm 42, and the insertion pin 43*b* which is fixed to the other of the sliding member 41 and the winding arm 42 and is inserted in the elongated hole 43*a*. The power transmission part 43 is configured to transmit power from the sliding member 41 to the winding arm 42 when the sliding member 41 slides forward or rearward, to rotate the winding arm 42. The power transmission part 43 converts the motion of the sliding member 41 in the sliding direction into a rotating motion to transmit power to the winding arm 42. In this embodiment, the elongated hole 43*a* is formed in the inner part 41*e* of the first slide support part 41*b*.

The extending direction of the elongated hole 43*a* is slightly oblique to a direction perpendicular to the sliding direction of the sliding member 41 (i.e., the width direction), so that the inner side (right side) is located forward of the outer side (left side). Moreover, the insertion pin 43*b* is fixed to the winding arm 42.

In detail, as illustrated in FIG. 5(*a*), in the power transmission part 43, when the sliding member 41 is located at the premovement position, the insertion pin 43*b* is located at an outward part of the elongated hole 43*a*. Moreover, in this state, the insertion pin 43*b* is located forward and inward of the rotation shaft 42*a*. From this state, when the sliding member 41 is slid rearwardly, the insertion pin 43*b* is pushed rearwardly by the front part of the elongated hole 43*a*. Therefore, while the insertion pin 43*b* moves inside the elongated hole 43*a*, the winding arm 42 rotates counterclockwise in FIG. 5(*a*). Then, when the sliding member 41 reaches the movement stopped position, the winding arm 42 reaches the winding finished position (the position in FIG. 5(*b*)). Since the sliding range of the sliding member 41 is regulated, the rotating range of the winding arm 42 is also regulated. The winding arm 42 is rotatable within a range from the prerotation position to the winding finished position.

Moreover, when the sliding member 41 is slid forward from the state where the sliding member 41 is located at the movement stopped position, the insertion pin 43*b* is pushed forward by the rear part of the elongated hole 43*a*. Therefore, while the insertion pin 43*b* moves inside the elongated hole 43*a*, the winding arm 42 rotates clockwise in FIG. 5(*a*). Then, when the sliding member 41 reaches the premovement position, the winding arm 42 reaches the prerotation position. Thus, the winding arm 42 rotates so as to be interlocked with the slide movement of the sliding member 41. Moreover, at the timing when the winding arm 42 reaches the prerotation position, the bulged part 42*e* of the arm part 42*b* contacts the third switch 83 and switches the third switch 83 to an ON state.

Here, in order to wind the binding material 2, it is necessary to rotate the winding arm 42 comparatively largely. For that purpose, it is possible to increase the sliding range of the sliding member 41. However, if the sliding range of the sliding member 41 is increased, the pushing distance of the sliding member 41 becomes longer for the user. Moreover, it is also possible to rotate the winding arm 42 largely by shortening the distance between axes of the rotation shaft 42*a* and the insertion pin 43*b*. However, in this case, the force required for moving the sliding member 41 increases. Thus, in this embodiment, in a state where the sliding member 41 is located at the premovement position so that the force required for moving the sliding member 41 does not become excessively large, while suppressing the sliding range, a distance X from the rotational center of the winding arm 42 to an acting point A at which the force transmitted from the sliding member 41 acts on the winding arm 42 is set within a numerical value range of 0.5 cm or more and 3 cm or less.

[Configuration of Twisting Device]

Figure 3A:
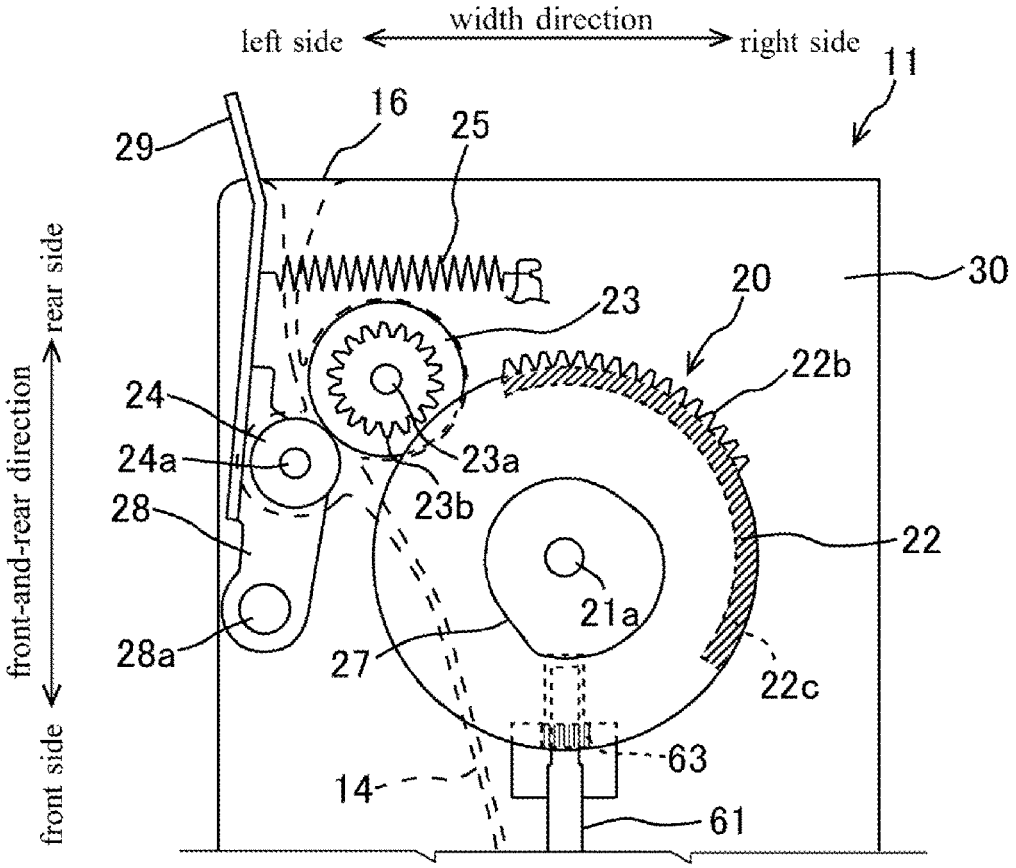
FIG. 3(*a*) is a top view of the inside of a rear side of the body part seen from above, where a switch mounting plate and a switch operating plate are removed, and FIG. 3(*b*) is a rear view of the inside of the body part seen from the rear side.
Figure 3B:
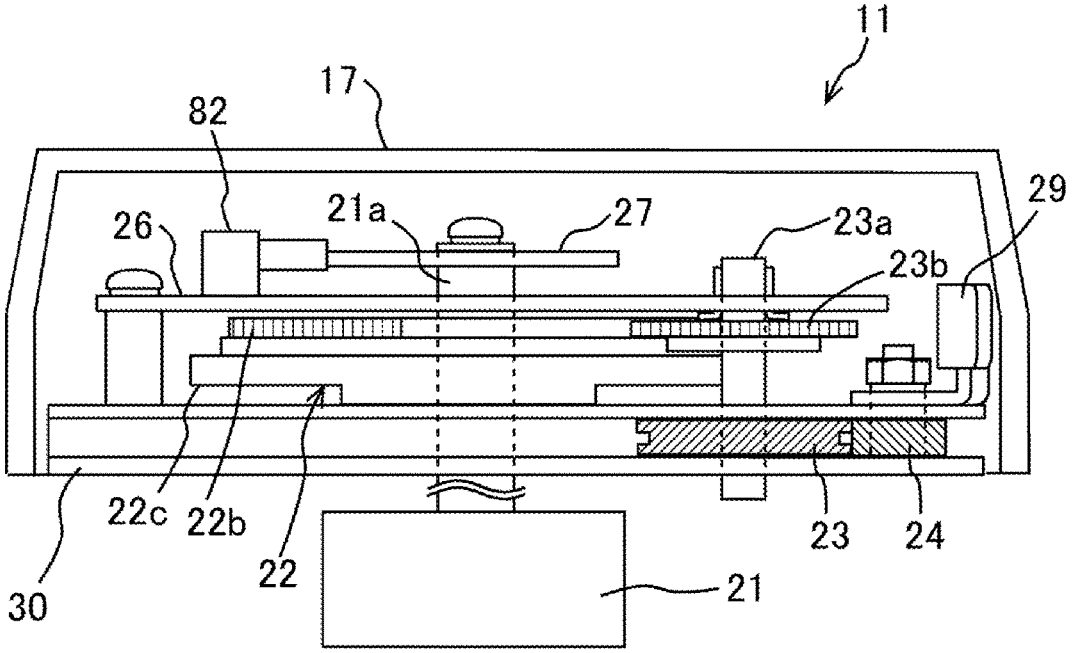

The twisting device 60 includes, as illustrated in FIG. 2, the twist shaft 61 which is rotatably provided and a hooking part 62 which is fixed to one end part (front end part) of the twist shaft 61, and as illustrated in FIG. 3, a twist-side gear 63 provided to the other end part (rear end part) of the twist shaft 61.

The twist shaft 61 extends in the front-and-rear direction from a position slightly rearward of the movement passages 13 to a position slightly forward of the rotation shaft 21*a* of the rotary disk 22. The twist shaft 61 overlaps at the other end side with the front side part of the rotary disk 22 from below. In the top view, the axis of the twist shaft 61 is located at the center of the movement passage 13 in the width direction. Moreover, the twist-side gear 63 is, for example, a spur gear, and meshes with the backside gear 22*c* of the rotary disk 22. Note that the backside gear 22*c* and the twist-side gear 63 are designed so that, when the rotary disk 22 makes one revolution, the twist shaft 61 rotates by a multiple of a natural number (e.g., 3 times). Thus, when the rotary disk 22 makes one revolution, each of the hooking part 62 and a movable blade 72 (described below) returns to the same rotational position as before the rotation.

When the twist shaft 61 rotates, the hooking part 62 twists the binding material 2 by rotating while it hooks the binding material 2 wound around the to-be-bound object 1. In detail, the hooking part 62 hooks the binding material 2 wound around the to-be-bound object 1 at a near side and a tip-end side of the folded part, when the twist shaft 61 rotates. In a broken line at the lower right of FIG. 5(*b*), a view of the hooking part 62 seen from the front is illustrated. The hooking part 62 is a member of a substantially S-shape or Z-shape, having a hook which catches the binding material 2 at the near side of the folded part, and a hook which catches the binding material 2 at the tip-end side of the folded part. The hooking part 62 is disposed slightly rearward of the binding executing position 13*a* in the movement passage 13.

[Configuration of Cutting Device]

As illustrated in FIG. 5(*a*), the cutting device 70 includes the stationary blade 71 fixed to the support plate part 30, and the movable blade 72 fixed to the twist shaft 61 at a position which is forwardly adjacent to the stationary blade 71. The cutting device 70 shares the twist shaft 61 with the twisting device 60. The stationary blade 71 is located at the exit 14*a* of the binding material passage 14 in the front-and-rear direction. The cutting device 70 cuts the near side of the folded part of the binding material 2 at the exit 14*a* of the binding material passage 14.

[Configuration of Putting-Aside Device]

In this embodiment, the binding machine 10 is further provided with the putting-aside device 90 which brings the binding material 2 closer to the twist shaft 61 before the binding material 2 is twisted by the twisting device 60. As illustrated in FIG. 5(*a*), the putting-aside device 90 includes the rotary arm 91 rotatably supported by the rotation shaft 91*a* fixed to the support plate part 30, a power transmission part 92 which transmits power to the rotary arm 91 from the sliding member 41, and an elastic member 93 which biases the rotary arm 91 by a restoring force.

When the sliding member 41 slides rearward, the power of the sliding member 41 is transmitted to the rotary arm 91 by the power transmission part 92. When the sliding member 41 is located at the premovement position, the rotary arm 91 is located at the prerotation position illustrated in FIG. 5(*a*). Then, when the sliding member 41 slides rearward, the rotary arm 91 rotates counterclockwise in FIG. 5(*a*) by the power of the sliding member 41, and it rotates from a prerotation position to a putting-aside finished position (a position in FIG. 5(*b*)).

The rotary arm 91 is a plate-shaped member extending forward from the rotation shaft 91*a*. The rotary arm 91 bends inwardly at an intermediate location. The rotary arm 91 located at the prerotation position extends obliquely leftward from the rotation shaft 91*a* to the bent part, and extends obliquely forward and rightward from the bent part to a tip-end part. Moreover, a protrusion 91*b* which bulges inwardly is formed in a rear part of the rotary arm 91. In the rotary arm 91 located at the putting-aside finished position, each of the protrusion 91*b* and a tip-end part 91*c* projects inwardly (the movement passage 13 side).

Moreover, the binding material 2 fed forward from the exit 14*a* of the binding material passage 14 hits the protrusion 91*b* of the rotary arm 91 located at the prerotation position. In detail, the binding material 2 hits a side surface of the protrusion 91*b* rearward of the tip end. The rearward side surface of the protrusion 91*b* located at the prerotation position extends obliquely rightward and forward in the plan view, and corrects the advancing direction of the binding material 2 fed from the exit 14*a* of the binding material passage 14 to substantially forward.

The power transmission part 92 includes a projection pin 92*a* fixed at an outward position of the rotary arm 91, and a peripheral part 92*b* rearward of the inner part 41*e* of the first slide support part 41*b*. The rearward peripheral part 92*b* extends obliquely so that the front side is closer to the inside (the movement passage 13 side). Therefore, when the sliding member 41 contacts the projection pin 92*a* in the process of sliding the sliding member 41 rearward, the projection pin 92*a* gradually moves inward, and the rotary arm 91 rotates the counterclockwise in FIG. 5(*a*). During this rotation, the protrusion 91*b* and the tip-end part 91*c* of the rotary arm 91 contact the binding material 2 at the near side of the folded part from outside, and push the binding material 2 inwardly at the two locations.

The elastic member 93 biases the rotary arm 91 to the opposite direction for the rotational direction from the prerotation position to the putting-aside finished position. As the elastic member 93, a coil spring can be used. The elastic member 93 is attached at one end part to a support pin 30*c* fixed to the support plate part 30, and is attached at the other end part to a protrusion piece provided at an outward position of the rotary arm 91. In the process of sliding the sliding member 41 forward, the elastic member 93 returns the rotary arm 91 to the prerotation position.

[Rotation Control of Rotary Disk]

The binding machine 10 includes the first switch 81, the second switch 82, and the third switch 83 in order to turn on and turn off the motor 21. Each of the first switch 81 and the third switch 83 is a switch for switching the motor 21 to an ON state, when its contacts close. The second switch 82 is a switch for switching the motor 21 to an OFF state, both when its contacts close and open.

Figure 6A:
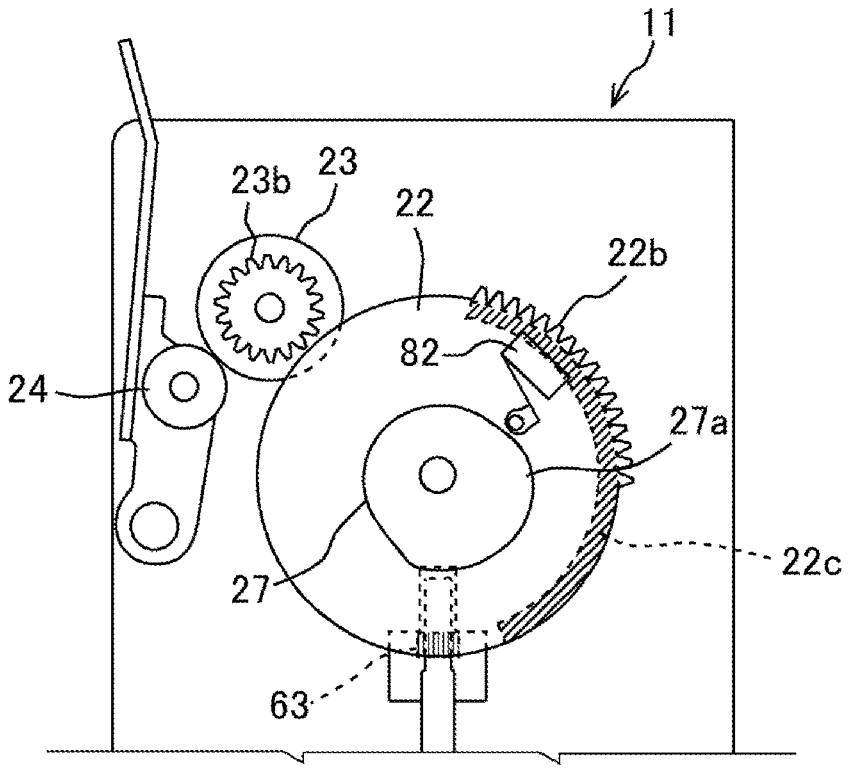
FIG. 6(*a*) is a top view of a rotary disk and a switch operating plate before a first switch is pushed and the rotary disk is rotated, and FIG. 6(*b*) is a top view of the rotary disk and the switch operating plate when a second switch is pushed and the rotary disk is stopped.
Figure 6B:
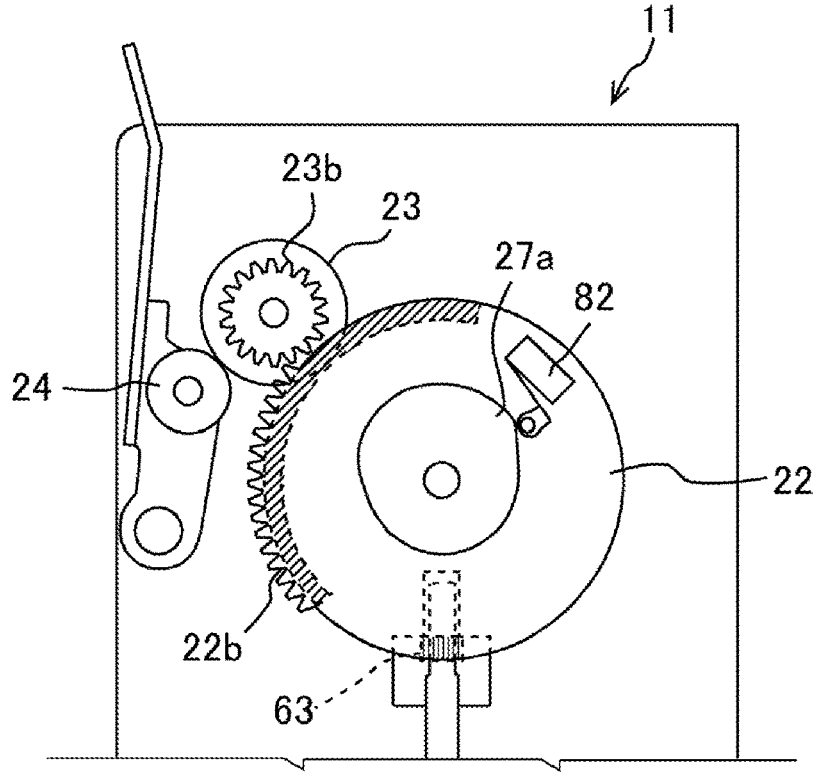

The first switch 81 is pushed by the protrusion 41*h* of the sliding member 41 at a timing when the sliding member 41 slides rearward and reaches the movement stopped position, and is then switched to the ON state (see FIG. 4(*b*)). When the first switch 81 is switched to the ON state, electric power is supplied to the motor 21, and the motor 21 starts rotating. As a result, each of the rotary disk 22 and the switch operating plate 27 begins to rotate clockwise from the state illustrated in FIG. 6(*a*). Then, when the rotary disk 22 and the switch operating plate 27 rotate by a given angle, the second switch 82 is pushed by the bulged part 27*a* of the switch operating plate 27, as illustrated in FIG. 6(*b*). Then, the contacts of the second switch 82 become in the contacted state, and the motor 21 is switched to the OFF state. The switch operating plate 27 stops in a state where the front side of the bulged part 27*a* in the rotational direction contacts the second switch 82.

Moreover, the third switch 83 is pushed by the bulged part 42*e* of the winding arm 42 at a timing when the winding arm 42 returns to the prerotation position, and it is switched to the ON state (see FIG. 5(*a*)). When the third switch 83 is switched to the ON state, electric power is supplied to the motor 21, and the motor 21 starts rotating. As a result, each of the rotary disk 22 and the switch operating plate 27 again starts rotating. Then, when the switch operating plate 27 rotates by a given angle from the state of FIG. 6(*b*), the bulged part 27*a* of the switch operating plate 27 separates from the second switch 82 (see FIG. 6(*a*)). Then, the contacts of the second switch 82 also become in the separated state, and the motor 21 stops.

During a period from the switching of the motor 21 to the ON state by the first switch 81 until the motor 21 stops (hereinafter, referred to as a "first rotation period"), the frontside gear 22*b* does not mesh with the roller-side gear 23*b*, above the rotary disk 22, but the backside gear 22*c* meshes with the twist-side gear 63 below the rotary disk 22. During the first rotation period, only the twist shaft 61 rotates among the driving roller 23 and the twist shaft 61. Note that, in FIG. 6, a formation area of each of the backside gear 22*c* and the twist-side gear 63 is hatched.

During a period from the switching of the motor 21 to the ON state by the third switch 83 until the motor 21 stops (hereinafter, referred to as a "second rotation period"), the frontside gear 22*b* meshes with the roller-side gear 23*b* at a location above the rotary disk 22, and the backside gear 22*c* does not mesh with the twist-side gear 63 at a location below the rotary disk 22. During the second rotation period, only the driving roller 23 rotates among the driving roller 23 and the twist shaft 61.

[Method of Using Binding Machine]

A method of using the binding machine 10 is described. Below, the description is given from a state where an end part of the binding material 2 is guided to a position where it is windable around the to-be-bound object 1 by the winding arm 42 (the state in FIG. 5(*a*)). In this state, it is in a state immediately before the backside gear 22*c* of the rotary disk 22 meshes with the twist-side gear 63 of the twist shaft 61 (the state in FIG. 6(*a*)).

When the user moves the to-be-bound object 1 toward the binding executing position 13*a* from the entrance of the movement passage 13, the to-be-bound object 1 hits the position of the recess part 41*d* in the transversing part 41*a* of the sliding member 41 at an intermediate location of the movement passage 13, and the sliding member 41 pushed by the user starts sliding rearward from the premovement position, as illustrated in FIG. 5(*a*).

Then, the sliding motion of the sliding member 41 is converted into the rotating motion of the winding arm 42 through the power transmission part 43, and the winding arm 42 rotates counterclockwise. When the winding arm 42 rotates slightly from the prerotation position, the recess part 42*f* of the binding material holding part 42*c* catches the end part of the binding material 2. Then, when the winding arm 42 further rotates, the binding material 2 held by the recess part 42*f* is bent as illustrated in FIG. 5(*b*) so that it is folded back to the feeding side of the feeding device 20, and the to-be-bound object 1 reaches the binding executing position 13*a*.

When the to-be-bound object 1 reaches the binding executing position 13*a*, the sliding member 41 stops sliding at the movement stopped position, and the winding arm 42 stops the rotation at the winding finished position. In this state, as illustrated in FIG. 5(*b*), the binding material 2 is in the state where it is wound around the to-be-bound object 1.

Moreover, in the putting-aside device 90, the rearward peripheral part 92*b* of the sliding member 41 contacts and begins to push the projection pin 92*a* of the rotary arm 91 before the sliding member 41 reaches the movement stopped position. Then, when the sliding member 41 further slides rearward, the projection pin 92*a* moves inward and the rotary arm 91 rotates to the putting-aside finished position, as illustrated in FIG. 5(*b*). Therefore, the protrusion 91*b* and the tip-end part 91*c* of the rotary arm 91 contact from outside the binding material 2 at the near side of the folded part, and bring the binding material 2 closer to the twist shaft 61 at the two locations. As a result, the binding material 2 is securely pushed into the hook of the hooking part 62.

Moreover, at the timing when the sliding member 41 reaches the movement stopped position, the first switch 81 is pushed by the protrusion 41*h* of the sliding member 41 to be switched into the ON state, and the motor 21 drives, as illustrated in FIG. 4(*b*). Therefore, the first rotation period is started, and the rotary disk 22 rotates from the state of FIG. 6(*a*). During the first rotation period, the twist shaft 61 rotates as described above. The first rotation period ends when the second switch 82 is pushed by the switch operating plate 27 and the motor 21 stops, as illustrated in FIG. 6(*b*). During the first rotation period, the twist shaft 61 rotates by a given number of rotations. As a result, the binding material 2 is cut, the binding material 2 hooked on the hooking part 62 is twisted, and therefore, the binding of the to-be-bound object 1 is finished.

When the binding of the to-be-bound object 1 is finished, a preparation for binding a next to-be-bound object 1 is performed. In detail, when the user moves the to-be-bound object 1 outside the movement passage 13 after the binding is finished, the user's force is removed from the sliding member 41, and the sliding member 41 is returned to the premovement position by the first elastic member 51 and the second elastic member 52.

Then, the winding arm 42 returns to the prerotation position, and the rotary arm 91 also returns to the prerotation position. At the timing when the winding arm 42 returns to the prerotation position, the third switch 83 is pushed by the bulged part 42*e* of the winding arm 42, and the motor 21 again operates, as illustrated in FIG. 5(*a*). Therefore, the second rotation period is started, and the rotary disk 22 rotates from the state of FIG. 6(*b*). During the second rotation period, the driving roller 23 rotates as described above. The second rotation period ends when the switch operating plate 27 separates from the second switch 82 and the motor 21 stops, as illustrated in FIG. 6(*a*). During the second rotation period, the driving roller 23 rotates by a given number of rotations. Therefore, the end part of the binding material 2 located near the exit 14*a* of the binding material passage 14 is fed to the windable position.

[Effects etc. of Embodiment]

In this embodiment, the binding material 2 is wound around the to-be-bound object 1 by using the force for moving the to-be-bound object 1 to the binding executing position 13*a*. Thus, it is not necessary to transmit the power of the motor 21 to the winding arm 42, and the components which made the machine configuration of the conventional binding machine complicated can be omitted. Therefore, the binding machine 10 which can simplify the machine configuration can be provided.

Moreover, in this embodiment, since the slide returning part 45 for returning the sliding member 41 to the premovement position and also returning the winding arm 42 to the prerotation position is provided, the preparation for the next binding after the binding of the to-be-bound object 1 is finished can be automatically performed.

Moreover, in this embodiment, the twisting device 60 is driven by automatically driving the motor 21 by using the motion of the sliding member 41 when moving the to-be-bound object 1 to the binding executing position 13*a*. Moreover, the feeding device 20 is driven by automatically driving the motor 21 by using the motion of returning the winding arm 42. Therefore, the binding machine 10 can be automated with the simple configuration.

Moreover, in this embodiment, the binding material 2 is brought closer to the twist shaft 61 by using the force of moving the to-be-bound object 1 to the binding executing position 13*a*, before the binding material 2 is twisted. Therefore, the binding material 2 can securely be twisted by the hooking part 62.

Other Embodiments

Although in the above embodiment the slide returning part 45 for causing the restoring force to act on the sliding member 41 is provided as the elastic deforming part, the elastic member of the elastic deforming part may be connected to the winding arm 42 to cause the restoring force to act on the winding arm 42. In this case, the power is transmitted from the winding arm 42 to the sliding member 41, and the sliding member 41 returns to the premovement position.

Although in the above embodiment the sliding member 41 is provided as the movable member, the motion of the movable member is not limited to the sliding motion. For example, the movable member may be a member which is rotated by a force for moving the to-be-bound object 1 to the binding executing position 13*a*.

Although in this embodiment the slide support parts 41*b* and 41*c* are provided on both sides of the movement passage 13 as the movable member, the slide support part may be provided only on one side of the movement passage 13. Moreover, the movable member may not transverse the movement passage 13, as long as at least a part thereof is disposed in the movement passage 13 at the premovement position.

Although in the above embodiment, for the power transmission part 43, the elongated hole 43*a* is formed in the sliding member 41 among the sliding member 41 and the winding arm 42, and the insertion pin 43*b* is fixed to the winding arm 42, the elongated hole 43*a* may be formed in the winding arm 42, and the insertion pin 43*b* may be fixed to the sliding member 41.

In the above embodiment, the first switch 81 may be switched to the ON state by the winding arm 42, instead of the sliding member 41. Moreover, the third switch 83 may be switched to the ON state by the sliding member 41, instead of the winding arm 42.

INDUSTRIAL APPLICABILITY

The present disclosure is applicable to the binding machine etc. which binds the to-be-bound object by winding the binding material around the to-be-bound object and twisting it.

DESCRIPTION OF REFERENCE CHARACTERS

1 Object To Be Bound
2 Binding Material
10 Binding Machine
13 Movement Passage
13*a* Binding Executing Position
20 Feeding Device
22 Rotary Disk
40 Winding Device

41 Sliding Member (Movable Member)
42 Winding Member (Winding Arm)
60 Twisting Device

The invention claimed is:

1. A binding machine configured to bind an object to be bound by winding a binding material around the to-be-bound object and twisting the binding material, comprising:

a feeding device having an actuator configured to feed the binding material;

a movement passage through which the to-be-bound object to be moved to a binding executing position passes;

a sliding member configured to be moved from a pre-movement position where at least a part of the sliding member is disposed in the movement passage, by being pushed by the to-be-bound object when the to-be-bound object moves toward the binding executing position;

a winding member having a winding arm configured to wind the binding material fed to a given position by the feeding device around the to-be-bound object, by rotating while being transmitted power of the sliding member moved from the premovement position;

a twisting device configured to twist the binding material wound around the to-be-bound object by the winding member; and an elastic deforming part configured to return the sliding member to the premovement position, and return the winding member to a prerotation position before the winding member rotates to wind the binding material, by a restoring force.

2. The binding machine of claim 1, wherein the sliding member has a transversing part crossing the movement passage, a first slide support part connected to one side of the transversing part with respect to the movement passage and slidably supported, and a second slide support part connected to the other side of the transversing part with respect to the movement passage and slidably supported, wherein the elastic deforming part has a first spring part configured to cause a restoring force for returning the sliding member to the premovement position to act on the first slide support part, and a second spring part configured to cause a restoring force for returning the sliding member to the premovement position to act on the second slide support part, wherein, in the sliding member, a power transmission part configured to transmit power to the winding member is provided to the first slide support part, and wherein the first spring part has a larger restoring force than the second spring part.

3. The binding machine of claim 1, comprising:

a switch configured to contact the sliding member or the winding member at a timing when the to-be-bound object reaches the binding executing position, to be switched to an ON state; and a motor configured to be supplied with electric power when the switch is switched to the ON state to drive the twisting device.

4. The binding machine of claim 1, comprising:

a switch configured to contact the sliding member or the winding member at a timing when the sliding member returns to the premovement position, to be switched to an ON state; and a motor configured to be supplied with electric power when the switch is switched to the ON state to drive the feeding device.

5. The binding machine of claim 1, further comprising a binding material passage configured to guide to the given position the binding material inserted from outside, wherein the binding material fed by the feeding device advances in an area adjacent to the movement passage along the movement passage, to the given position from an exit of the binding material passage.

6. A binding machine configured to bind an object to be bound by winding a binding material around the to-be-bound object and twisting the binding material, comprising:

a feeding device having an actuator configured to feed the binding material;

a movement passage through which the to-be-bound object to be moved to a binding executing position passes;

a sliding member configured to be moved from a pre-movement position where at least a part of the sliding member is disposed in the movement passage, by being pushed by the to-be-bound object when the to-be-bound object moves toward the binding executing position;

a winding member having a winding arm configured to wind the binding material fed to a given position by the feeding device around the to-be-bound object, by rotating while being transmitted power of the sliding member moved from the premovement position; and a twisting device having a twisting arm configured to twist the binding material wound around the to-be-bound object by the winding member, wherein the sliding member is provided slidably along the movement passage, and wherein, in a state where the sliding member is located at the premovement position, a distance from a rotational center of the winding member to an acting point where a force transmitted from the sliding member acts on the winding member is 0.5 cm or more and 3 cm or less.

7. The binding machine of claim 6, comprising:

a switch configured to contact the sliding member or the winding member at a timing when the to-be-bound object reaches the binding executing position, to be switched to an ON state; and a motor configured to be supplied with electric power when the switch is switched to the ON state to drive the twisting device.

8. The binding machine of claim 6, comprising:

a switch configured to contact the sliding member or the winding member at a timing when the sliding member returns to the premovement position, to be switched to an ON state; and a motor configured to be supplied with electric power when the switch is switched to the ON state to drive the feeding device.

9. The binding machine of claim 6, further comprising a binding material passage configured to guide to the given position the binding material inserted from outside, wherein the binding material fed by the feeding device advances in an area adjacent to the movement passage along the movement passage, to the given position from an exit of the binding material passage.

10. A binding machine configured to bind an object to be bound by winding a binding material around the to-be-bound object and twisting the binding material, comprising:

a feeding device having an actuator configured to feed the binding material;

a movement passage through which the to-be-bound object to be moved to a binding executing position passes;

a sliding member to be moved from a premovement position where at least a part of the sliding member is disposed in the movement passage, by being pushed by the to-be-bound object when the to-be-bound object moves toward the binding executing position;

a winding member having a winding arm configured to wind the binding material fed to a given position by the feeding device around the to-be-bound object, by rotating while being transmitted power of the sliding member moved from the premovement position; and a twisting device configured to twist the binding material wound around the to-be-bound object by the winding member, wherein the twisting device has a twist shaft rotatably provided, and a hooking part fixed to the twist shaft and configured to rotate while the binding material wound around the to-be-bound object being hooked thereon when the twist shaft rotates, and wherein the binding machine is further provided with a putting-aside device configured to bring the binding material closer to the twist shaft before the binding material is twisted by the twisting device, the putting-aside device being moved by power of the sliding member moved from the premovement position being transmitted.

11. The binding machine of claim 10, comprising:

a switch configured to contact the sliding member or the winding member at a timing when the to-be-bound object reaches the binding executing position, to be switched to an ON state; and a motor configured to be supplied with electric power when the switch is switched to the ON state to drive the twisting device.

12. The binding machine of claim 10, comprising:

a switch configured to contact the sliding member or the winding member at a timing when the sliding member returns to the premovement position, to be switched to an ON state; and a motor configured to be supplied with electric power when the switch is switched to the ON state to drive the feeding device.

13. The binding machine of claim 10, further comprising a binding material passage configured to guide to the given position the binding material inserted from outside, wherein the binding material fed by the feeding device advances in an area adjacent to the movement passage along the movement passage, to the given position from an exit of the binding material passage.

* * * * *